US005410460A

United States Patent [19]

Liou

[11] Patent Number: 5,410,460

[45] Date of Patent: Apr. 25, 1995

[54] POSITIONING DEVICE FOR A STRING OF DECORATIVE LIGHTS

[76] Inventor: Ching-Chong Liou, P.O. Box 96-405, Taipei 10098, Taiwan, Prov. of China

[21] Appl. No.: 216,939

[22] Filed: Mar. 24, 1994

[51] Int. Cl.[6] ..... F21V 21/16

[52] U.S. Cl. ..... 362/250; 362/252; 362/332; 362/396; 362/806

[58] Field of Search ..... 362/123, 226, 249, 250, 362/252, 360, 363, 391, 396, 374, 375, 806, 332, 348

[56] References Cited

U.S. PATENT DOCUMENTS

| | | | |
|---|---|---|---|
| 1,481,719 | 1/1924 | Lui | 362/363 |
| 3,873,880 | 3/1975 | Riddell | 362/806 |
| 4,989,120 | 1/1991 | Davis et al. | 362/806 |
| 5,021,935 | 6/1991 | Gary | 362/806 |

FOREIGN PATENT DOCUMENTS

| | | | |
|---|---|---|---|
| 2535438 | 5/1984 | France | 362/360 |

*Primary Examiner*—Ira S. Lazarus

*Assistant Examiner*—Y. Quach

[57] ABSTRACT

A positioning device for a Christmas light string, which comprises a plurality of lamp sockets, of which each is mounted with a decorative casing; the decorative casing includes a reflecting shade and a transparent shade; the center of the reflecting shade has a plug hole for receiving the lamp socket mounted with a spun-wire cable; the reflecting shade and the transparent shade can be assembled together by means of several fastening assemblies; the ring flanges of the reflecting shade and the transparent shade are furnished with at least two symmetrical positioning hooks, of which each includes an opening, a guide slot and a positioning slot for receiving two single wires respectively extended out of the lamp socket. The lamp socket is clamped by means of the spun-wire cable so as to have the decorative casing positioned in a direction desired without swinging or overhanging at random; further, the wires extended out of the lamp socket will be retained in the positioning hooks to have the transparent shade positioned in a direction desired without being separated from the reflecting shade.

1 Claim, 5 Drawing Sheets

POSITIONING DEVICE FOR A STRING OF DECORATIVE LIGHTS

BACKGROUND OF THE INVENTION

1. Field of the Invention

This invention relates to a string of decorative lights, and particularly to a positioning device for a string of decorative lights.

2. Description of the Prior Art

In the conventional string of decorative lights, two or more than two wires are spun together for attaching a series of lamp sockets; the sockets of such string of decorative lights are subject to swinging or overhanging.

In another conventional string of decorative lights, as shown in Taiwan Patent application No. 75205120, it comprises two wires spun together and a plurality of retaining rings so as to prevent the lamps from swinging and overhanging at random; each lamp socket is furnished with a retaining ring molded integrally. Each retaining ring has an opening for holding or pulling out wires so as to enable the lamp socket fastened to the wires spun, i.e., the lamp sockets are positioned in a direction same as that of the wires spun.

In still another conventional string of decorative lights, it has a spun-wire cable made of more than two wires, and a plurality of lamp sockets with various kinds of decorative casings, which are not positioned in a given direction, and are subject to swinging and overhanging at random. Further, since the decorative casing is made of two member by means of a fastening means, the two members are subject to becoming separated each other upon being moved from one place to another, or being hit.

SUMMARY OF THE INVENTION

The prime object of the present invention is to provide a positioning device, which comprises a plurality of lamp sockets, of which each is mounted with a decorative casing; the decorative casing includes a reflecting shade and a transparent shade; the center of the reflecting shade has a plug hole for receiving the lamp socket with a spun-wire cable; the reflecting shade and the transparent shade can be assembled together by means of several fastening assemblies; the ring flanges of the reflecting shade and the transparent shade are furnished with at least two symmetrical positioning hooks, of which each includes an opening, a guide slot and a positioning slot for receiving two single wires respectively extended out of the lamp socket. The lamp socket is clamped by means of the spun-wire cable so as to have the decorative casing positioned in a direction desired without swinging or overhanging at random.

Another object of the present invention is to provide a positioning device, in which the lamp socket is mounted with a decorative casing. The ring flange of the transparent shade is furnished with two symmetrical positioning hooks for receiving two single wires extended out of the lamp socket. The transparent shade of the decorative casing will be positioned in a given direction after the two wires extended out of the lamp socket being retained in the positioning hooks without being dropped out of the decorative casing.

A further object of the present invention is to provide a positioning device, of which the symmetrical positining hook on the ring flange of the transparent shade is used for moving a single wire through the opening, the guide slot and the positioning slot thereof; after the single wire is retained in the positioning slot, the single wire would not be pulled out of the positioning hook upon the spun-wire cable being pulled.

A still further object of the present invention is to provide a positioning device, of which each of the symmetrical positioning hooks is a single hook, or a dual hook for retaining a single wire.

DETAILED DESCRIPTION OF THE PREFERRED EMBODIMENTS

Figure 1:
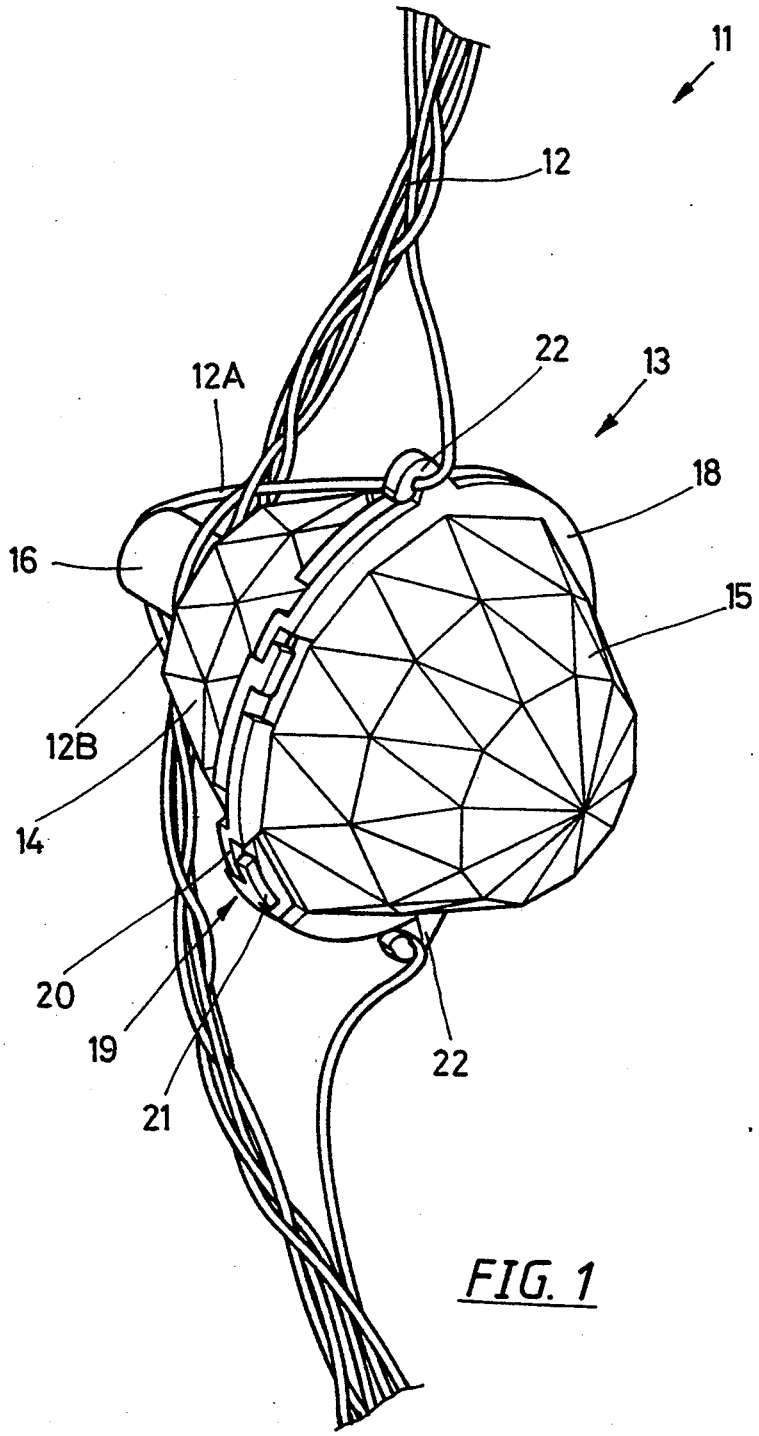
FIG. 1 is a perspective and front view of an embodiment according to the present invention, showing a spun wire cable with a decorative casing.
Figure 2:
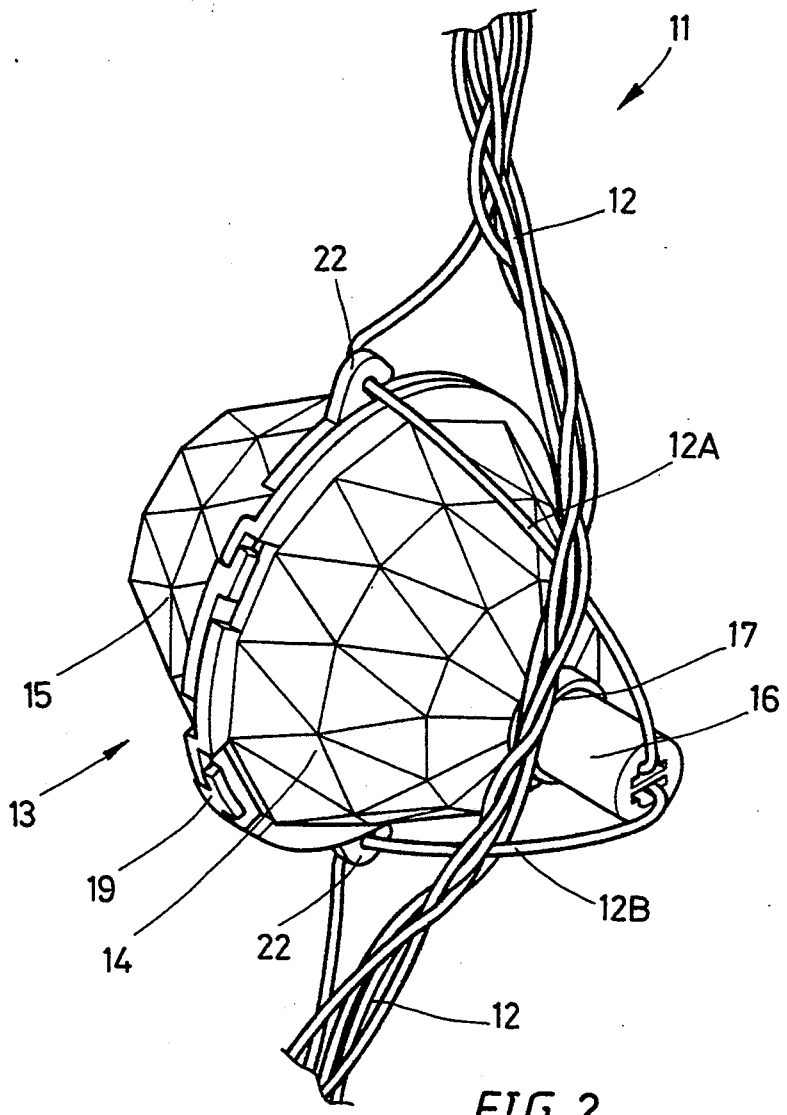
FIG. 2 is a perspective and rear view of the present invention as shown in FIG. 1.
Figure 3:
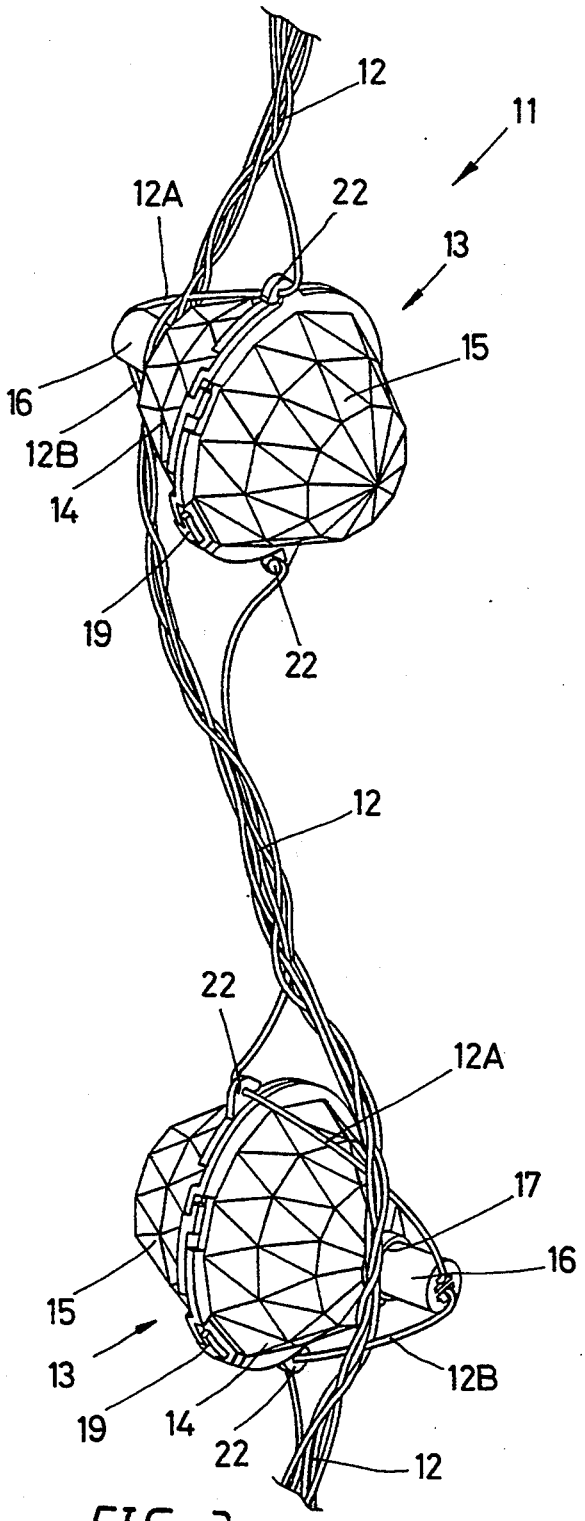
FIG. 3 is a perspective view of the present invention, showing the spun-wire cable mounted with a plurality of decorative casings.
Figure 4:
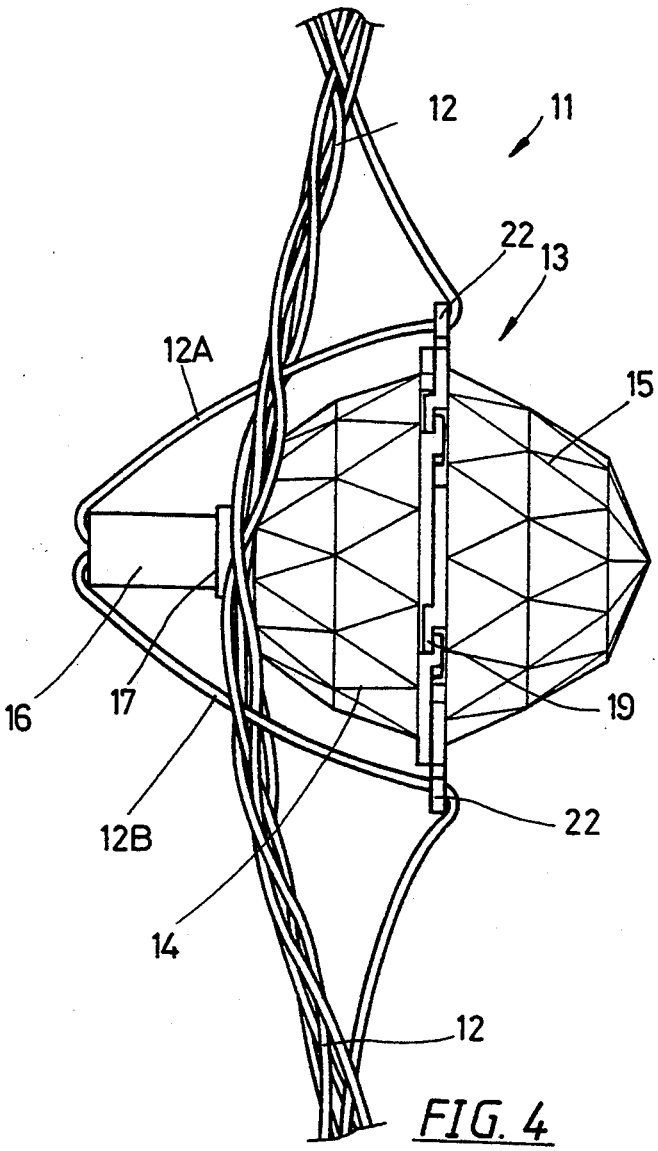
FIG. 4 is a side view of the present invention, showing relation between the decorative casing and the spun-wire cable thereof.
Figure 5:
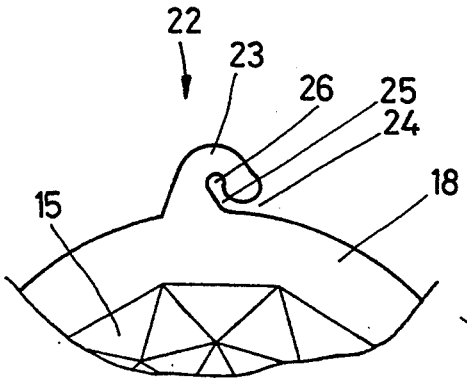
FIG. 5 is a plan view of a single hook according to the present invention.

The string of decorative lights according to the present invention comprises a spun-wire cable and a plurality of lamp sockets; the string of decorative lights is mainly used for mounting around a Christmas tree for decoration purpose. Each lamp socket is used to fasten a decorative casing. The shape of the decorative casing 13 can be varied one another so as to obtain a better decoration.

The positioning device for the string of decorative lights as shown in FIGS. 1 to 5 comprises a spun-wire cable 12 and a plurality of lamp sockets 16, of which each is fastened with a decorative casing 13; each decorative casing 13 has two symmetrical positioning hooks 22 to hook two single wires 12A and 12B respectively so as to set the decorative casing 13 on the lamp socket 16 at given position facing a direction desired without overhanging or swinging as a result of its weight or an external force.

The decorative casing 13 includes a reflecting shade 14 and transparent shade 15. The two contact ring flanges 18 between the reflecting bowl 14 and the transparent shade 15 are furnished with a plurality of fastening assemblies 19, of which each includes two fastening arms 20 and 21. When the reflecting shade 14 and the transparent shade 15 are closed together, and turned relatively, the fastening arms 20 and 21 will be mated each other to cause the reflecting shade 14 and the transparent shade 15 to be fastened together. The center bottom of the reflecting shade 14 has a plug hole 17 for receiving the lamp socket 16. The inner surface of the reflecting shade 14 is used as a reflector to reflect the light of a lamp. The transparent shade 15 is a transparent member to provide an illumination and decoration function.

The decorative casing 13 includes the reflecting shade 14 and the transparent shade 15. After the decorative casing 13 is mounted to the lamp socket 16, the casing 13 would not overhang or swing through its weight or external force because of two symmetrical positioning hooks 22 on the ring flange 18 of the transparent shade 15 being held with two single wires 12A and 12B. The positioning hooks 22 extend out of the ring flange 18 of the transparent shade 15; each positioning hook 22 includes a single hook 23, an opening 24 with a guide slot 25, and a positioning slot 26. As soon as a wire is inserted into the positioning slot 26, it would not be pulled out of the slot 26 in case of being swung or hit, i.e., the two single wires 12A and 12B being held in the positioning hooks 22 so as to have the decorative casing 13 attached to the spun-wire cable 12. After the spun-wire cable 12 is mounted around the lamp socket 16, two single wires 12A and 12B are extended out of the lamp socket 16, and then are retained in two positioning hooks 22 of the decorative casing 13. As soon as the single wires are pulled out to be retained in the hooks 22, the spun-wire cable 12 will be pulled close to the decorative casing so as to reduce the tension of the single wires 12A and 12B; at the same time, the spun-wire cable 12 mounted with a lamp socket 16 will provide the decorative casing 13 with a positioning function without swinging or over-hanging; therefore, the two single wires 12A and 12B are retained in the positioning hooks 22; after the reflecting shade 14 and the transparent shade 15 are assembled together by means of fastening assemblies 19, the transparent shade 15 would not turn or separate from the reflecting shade 14.

Figure 6:
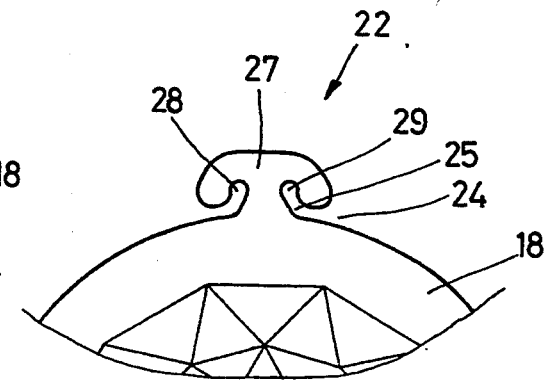
FIG. 6 is a plan view of a dual hook according to the present invention.
Figure 7:
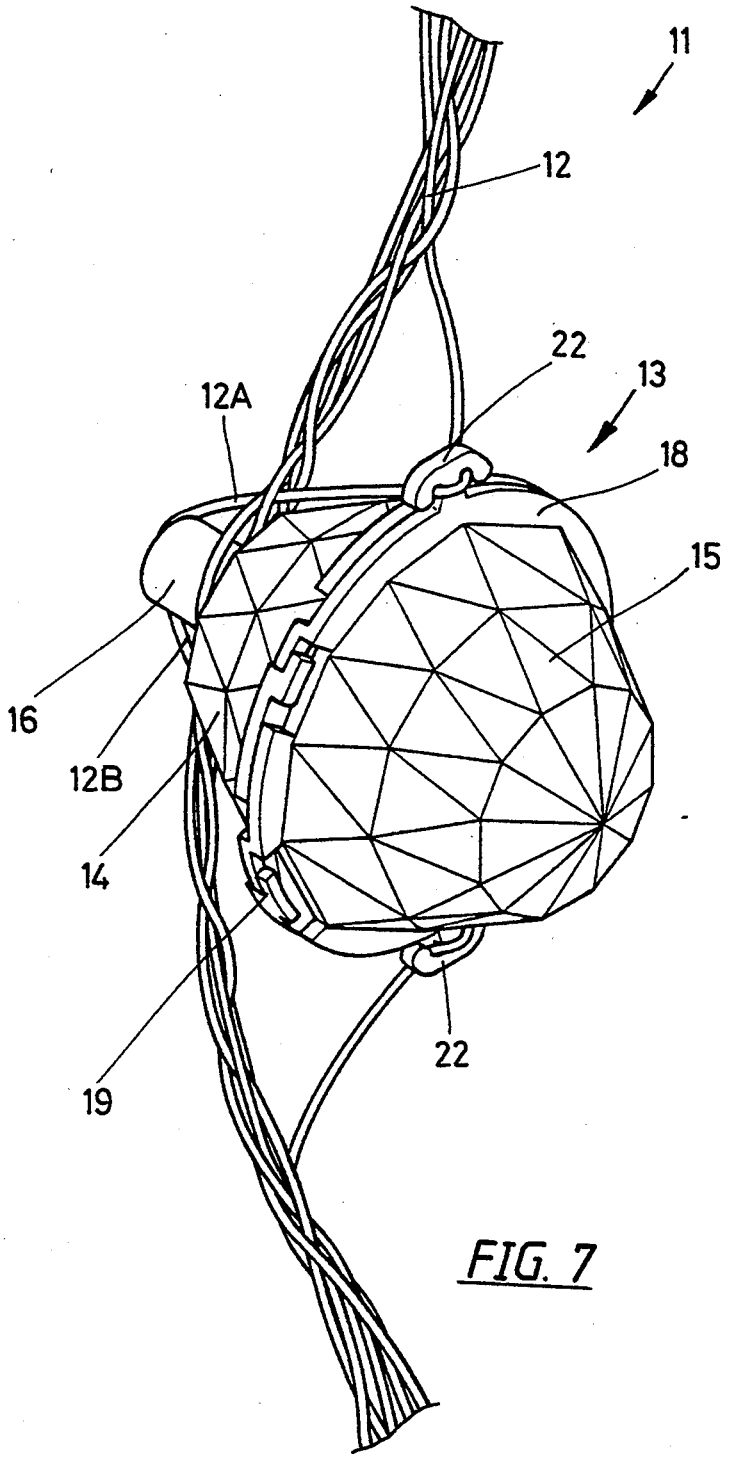
FIG. 7 is a perspective view of the present invention, showing the decorative casing being positioned with a dual hook.

The positioning hooks 22 furnished symmetrically on the ring flange 18 of the transparent shade 15 are single hooks. Referring to FIGS. 6 and 7, the single hook has been modified into a dual hook 27 with two symmetrical positioning slots 28 and 29, which are used for retaining wires respectively. Each of the dual hooks 27 includes two openings 24 and two guide slots 25 for retaining single wires 12A and 12B respectively, i,e., a single wire is inserted in the positioning slot 28 first, and then in the positioning slot 29; of course, the single wire may also be inserted in only one of the positioning slots 28 and 29, if so desired.

According to the aforesaid description for the embodiments of the present invention, it is apparent that the present invention has furnished the conventional string of decorative lights with a new and novel improvement on the positioning means thereof, and therefore the present invention is deemed practical and unique.

I claim:

1. A positioning device for a string of decorative lights comprising a spun-wire cable, a plurality of decorative casings and a plurality of lamp sockets; each of said decorative casings including a reflecting shade and a transparent shade, said reflecting shade and said transparent shade are fastened together by means of several fastening assemblies; a center of said reflecting sahde having a plug hole to be mounted therein with said lamp socket which being connected to a first wire and a second wire, said first and second wires of said lamp socket joined with another second and first wires of adjacent lamp sockets respectively; said first and second wires being mounted in two symmetrical positioning hooks respectively on a ring flange of said transparent shade; each of said positioning hooks having an opening, a guide slot and a positioning slot; and each of said first and second wires passing through said spun-wire cable before being mounted in said positioning hook and then joining in said spun-wire cable so as to maintain said decorative casing facing in a direction as desired.

* * * * *